US010941660B2

(12) United States Patent
Geyer

(10) Patent No.: US 10,941,660 B2
(45) Date of Patent: Mar. 9, 2021

(54) OPPOSED PISTON ENGINE WITH OFFSET INLET AND EXHAUST CRANKSHAFTS

(71) Applicants: VOLVO TRUCK CORPORATION, Gothenburg (SE); Stephen Geyer, Greencastle, PA (US)

(72) Inventor: Stephen Geyer, Greencastle, PA (US)

(73) Assignee: Volvo Truck Corporation, Gothenburg (SE)

( * ) Notice: Subject to any disclaimer, the term of this patent is extended or adjusted under 35 U.S.C. 154(b) by 0 days.

(21) Appl. No.: 16/476,273

(22) PCT Filed: Mar. 20, 2017

(86) PCT No.: PCT/US2017/023225
§ 371 (c)(1),
(2) Date: Jul. 6, 2019

(87) PCT Pub. No.: WO2018/174850
PCT Pub. Date: Sep. 27, 2018

(65) Prior Publication Data
US 2020/0003058 A1 Jan. 2, 2020

(51) Int. Cl.
*F01B 7/14* (2006.01)
*F02B 75/28* (2006.01)

(52) U.S. Cl.
CPC ..... *F01B 7/14* (2013.01); *F02B 75/28* (2013.01)

(58) Field of Classification Search
CPC ..... F02B 75/28; F02B 75/282; F02F 7/0019; F01B 7/02; F01B 7/00; F01B 7/14; F01B 7/16
See application file for complete search history.

(56) References Cited

U.S. PATENT DOCUMENTS 2,054,232 A * 9/1936 Schneider ..... F01B 7/14 123/51 BA
2,886,018 A 5/1959 Cuddon-Fletcher
(Continued)

FOREIGN PATENT DOCUMENTS

| | | |
|---|---|---|
| DE | 19812800 A1 | 9/1999 |
| EP | 3061907 A1 | 8/2016 |
| GB | 816325 | 7/1959 |

OTHER PUBLICATIONS

European Official Action (Oct. 6, 2020) for corresponding European App. 17901792.6.
(Continued)

*Primary Examiner* — Hung Q Nguyen
(74) *Attorney, Agent, or Firm* — WRB-IP LLP

(57) ABSTRACT

In an opposed piston engine, an inlet piston crankshaft axis and an exhaust piston crankshaft axis both extend parallel to a central cylinder plane extending through a centerpoint of a cylinder of the engine and along a central axis of the cylinder. The inlet piston crankshaft axis and the exhaust piston crankshaft axis are both offset from the central cylinder plane. The inlet piston and the exhaust piston linked to the inlet piston crankshaft and the exhaust piston crankshaft are arranged so that the inlet piston closes an inlet port as the inlet piston moves from its bottom dead center toward its top dead center at substantially a same time as the exhaust piston closes the exhaust port as the exhaust piston moves from its bottom dead center toward its top dead center.

20 Claims, 6 Drawing Sheets

(56) References Cited

U.S. PATENT DOCUMENTS

| | | | | |
|---|---|---|---|---|
| 3,134,373 | A | 5/1964 | Schauer, Jr. | |
| 3,485,221 | A | 12/1969 | Feedback | |
| 2007/0028866 | A1* | 2/2007 | Lindsay | F01L 7/04 123/51 BA |
| 2007/0245892 | A1* | 10/2007 | Lemke | F02B 75/32 92/169.1 |
| 2010/0071671 | A1* | 3/2010 | Lemke | F01B 7/14 123/51 R |
| 2010/0282219 | A1* | 11/2010 | Alonso | F01B 3/10 123/51 AA |
| 2011/0289916 | A1* | 12/2011 | Dion | F02M 26/41 60/605.2 |
| 2012/0080007 | A1* | 4/2012 | Herold | F02B 75/28 123/299 |
| 2012/0266851 | A1* | 10/2012 | Hofbauer | F02B 25/04 123/69 R |
| 2016/0356216 | A1* | 12/2016 | Klyza | F16C 17/24 |
| 2017/0122185 | A1* | 5/2017 | Kessler | F02F 1/4285 |
| 2018/0128203 | A1* | 5/2018 | Koeberlein | F02B 75/282 |
| 2018/0202348 | A1* | 7/2018 | Holland | F02B 23/0633 |

OTHER PUBLICATIONS

International Search Report (Jun. 5, 2017) for corresponding International App. PCT/US2017/023225.

* cited by examiner

OPPOSED PISTON ENGINE WITH OFFSET INLET AND EXHAUST CRANKSHAFTS

BACKGROUND AND SUMMARY

The present invention relates generally to opposed piston engines.

In conventional, two stroke, opposed piston engines, an inlet piston is linked to an inlet piston crankshaft and an exhaust piston is linked to an exhaust piston crankshaft. As the inlet piston and the exhaust piston move toward each other in the engine cylinder toward their respective top dead centers, they close, respectively, inlet and exhaust ports. A combustion event occurs near the minimum volume when the pistons are at their respective top dead centers and then the inlet and exhaust pistons move in the cylinder toward their respective bottom dead centers. As the inlet and exhaust pistons move toward their respective bottom dead centers, they open the inlet and exhaust ports. Combustion gas is permitted to escape through the exhaust port while a charge of air enters through the inlet port. Fuel is directly injected into the center of the liner above the pistons. As the inlet and exhaust pistons reciprocate, they turn the inlet piston crankshaft and the exhaust piston crankshaft, respectively, and torque can be transmitted via the crankshafts, which are typically linked to one another.

It is typically desirable for the inlet port to open after the exhaust port has opened so that pressure in the cylinder will be reduced somewhat before air is introduced to avoid blow back of exhaust gas into the inlet plenum and manifold. One way of accomplishing this is by providing a crankshaft phase shift so that the movement of the inlet piston lags the movement of the exhaust piston by a certain number of crankshaft angle degrees (CAD). A drawback to the crankshaft phase shift is that, during operation, it is typically necessary for the inlet piston to be moving toward top dead center when a combustion event occurs, which results in so-called reverse torsional losses as the inlet piston moves toward top dead center against the force of the expanding combustion gases. Further, by having the pistons move out of phase, the engine components are subjected to increased stresses, tending to necessitate the use of strong, typically heavy components.

Another way of accomplishing desired inlet and exhaust port opening and closing timing without necessarily providing a crankshaft phase shift is by providing an exhaust port valve to close the exhaust port at a desired time (usually at about the same time or shortly before the closure of the inlet port) while opening the exhaust port before the inlet port is opened. An inlet port valve may occasionally also be provided. The use of an exhaust port valve and/or an inlet port valve complicates the operation of the engine and provides additional equipment that is potentially subject to breakage.

It is desirable to provide an opposed piston engine that eliminates the need for crankshaft phase shifts. It is also desirable to provide an opposed piston engine that eliminates the need for an exhaust and/or an inlet port valve.

According to an aspect of the present invention, an opposed piston engine comprises a cylinder having an inlet port and an exhaust port disposed on opposite sides of a centerpoint of the cylinder, an inlet piston arranged to reciprocate in the cylinder between an inlet piston bottom dead center position (IPBDC) and an inlet piston top dead center position (IPTDC), the inlet piston closing the inlet port when the inlet piston moves through an inlet port closed position (PCP) as the inlet piston moves through at least a distance of an axial height (HIP) of the inlet port from IPBDC toward IPTDC and the inlet piston opening the inlet port when the inlet piston moves through the IPCP as the inlet piston moves from IPTDC to IPBDC, an exhaust piston arranged to reciprocate in the cylinder between an exhaust piston bottom dead center position (EPBDC) and an exhaust piston top dead center position (EPTDC), the exhaust piston closing the exhaust port when the exhaust piston moves through an exhaust port closed position (EPCP) as the exhaust piston moves through at least a distance of an axial height (IHEP) of the exhaust port from EPBDC toward EPTDC and the exhaust piston opening the exhaust port when the exhaust piston moves through the EPCP as the exhaust piston moves from EPTDC to EPBDC, an inlet piston crankshaft arranged to rotate about an inlet piston crankshaft axis of rotation and connected to the inlet piston by an inlet piston piston rod, and an exhaust piston crankshaft arranged to rotate about an exhaust piston crankshaft axis of rotation and connected to the exhaust piston by an exhaust piston piston rod. The inlet piston crankshaft axis and the exhaust piston crankshaft axis both extend parallel to a central cylinder plane extending through the centerpoint of the cylinder and along a central axis of the cylinder, the inlet piston crankshaft and the exhaust piston crankshaft are arranged to rotate in phase, and the HIP and the HEP are selected and the inlet piston crankshaft axis and the exhaust piston crankshaft axis are both offset from the central cylinder plane such that the inlet piston moves through the IPCP as the inlet piston moves from IPBDC toward IPTDC at substantially a same time as the exhaust piston moves through the EPCP as the exhaust piston moves from EPBDC toward EPTDC.

In accordance with another aspect of the present invention, an opposed piston engine comprises a cylinder having an inlet port and an exhaust port disposed on opposite sides of a centerpoint of the cylinder, an inlet piston arranged to reciprocate in the cylinder between an inlet piston bottom dead center position (IPBDC) and an inlet piston top dead center position (IPTDC), an exhaust piston arranged to reciprocate in the cylinder between an exhaust piston bottom dead center position (EPBDC) and an exhaust piston top dead center position (EPTDC), an inlet piston crankshaft arranged to rotate about an inlet piston crankshaft axis of rotation and connected to the inlet piston by an inlet piston piston rod, and an exhaust piston crankshaft arranged to rotate about an exhaust piston crankshaft axis of rotation and connected to the exhaust piston by an exhaust piston piston rod. The inlet piston crankshaft axis and the exhaust piston crankshaft axis both extend parallel to a central cylinder plane extending through the centerpoint of the cylinder and along a central axis of the cylinder, wherein the inlet piston crankshaft axis and the exhaust piston crankshaft axis are both offset from the central cylinder plane, and wherein the inlet piston and the exhaust piston are arranged so that the inlet piston closes the inlet port as the inlet piston moves from IPBDC toward IPTDC at substantially a same time as the exhaust piston closes the exhaust port as the exhaust piston moves from EPBDC toward EPTDC.

In accordance with yet another aspect of the present invention, a method of operating an opposed piston engine is provided, the opposed piston engine including a cylinder having an inlet port and an exhaust port disposed on opposite sides of a centerpoint of the cylinder. According to the method an inlet piston is reciprocated in the cylinder between an inlet piston bottom dead center position (IPBDC) and an inlet piston top dead center position (IPTDC) and thereby rotating an inlet piston crankshaft connected to the inlet piston by an inlet piston piston rod about an inlet piston crankshaft axis of rotation. An exhaust piston is reciprocated in the cylinder between an exhaust piston bottom dead center position (EPBDC) and an exhaust piston top dead center position (EPTDC) and thereby rotating an exhaust piston crankshaft connected to the exhaust piston by an exhaust piston piston rod about an exhaust piston crankshaft axis of rotation. Both the inlet piston crankshaft axis and the exhaust piston crankshaft axis are offset from a central cylinder plane extending through the centerpoint of the cylinder and along a central axis of the cylinder, the inlet piston crankshaft axis and the exhaust piston crankshaft axis both extending parallel to the central cylinder plane, so that the inlet piston closes the inlet port as the inlet piston moves from IPBDC toward IPTDC at substantially a same time as the exhaust piston closes the exhaust port as the exhaust piston moves from EPBDC toward EPTDC.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
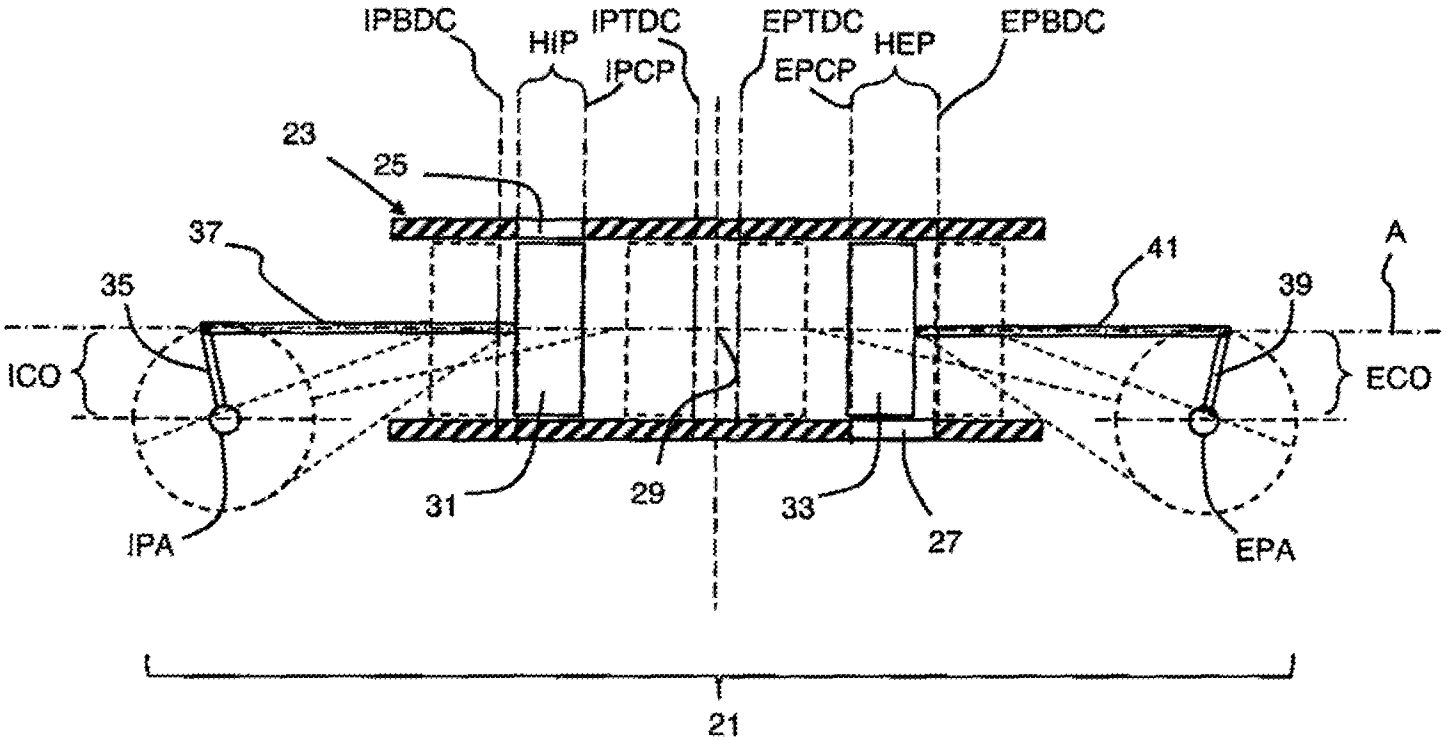
FIG. 1 is a schematic view of an opposed piston engine according to an aspect of the present invention.

An opposed piston engine 21 according to an aspect of the present invention is shown schematically in FIG. 1. FIG. 1 is merely intended to schematically illustrate features of the invention for purposes of discussion and does not necessarily show optimal relative sizes or positions of features. The engine 21 includes a cylinder 23 having an inlet port 25 and an exhaust port 27 disposed on opposite sides of a centerpoint 29 of the cylinder. The inlet port 25 and the exhaust port 27 may be one opening or, more typically, particularly for the inlet port, a series of openings around the liner of the cylinder. The inlet port openings may be the same size but are not necessarily the same size, and the outlet port openings may be the same size but are not necessarily the same size.

The engine 21 includes an inlet piston 31 arranged to reciprocate in the cylinder 23 between an inlet piston bottom dead center position (IPBDC) (shown in phantom) and an inlet piston top dead center position (IPTDC) (shown in phantom). The inlet piston 31 closes the inlet port 25 when the inlet piston moves through an inlet port closed position (IPCP) as the inlet piston moves through at least a distance of an axial height (HIP) of the inlet port from IPBDC toward IPTDC and the inlet piston opening the inlet port when the inlet piston moves through the IPCP as the inlet piston moves from IPTDC to IPBDC.

The engine 21 includes an exhaust piston 33 arranged to reciprocate in the cylinder 23 between an exhaust piston bottom dead center position (EPBDC) (shown in phantom) and an exhaust piston top dead center position (EPTDC) (shown in phantom). The exhaust piston 33 closes the exhaust port 27 when the exhaust piston moves through an exhaust port closed position (EPCP) as the exhaust piston moves through at least a distance of an axial height (HEP) of the exhaust port from EPBDC toward EPTDC and the exhaust piston opening the exhaust port when the exhaust piston moves through the EPCP as the exhaust piston moves from EPTDC to EPBDC.

The EPBDC is illustrated in FIG. 1 as being at the bottom end of the exhaust port 27, however, the EPBDC may be axially further below the bottom end of the exhaust port. There is typically a gap between the inlet piston 31 and the exhaust piston 33 when they are at IPTDC and EPTDC. A fuel injector (not shown) injects fuel into the cylinder at a point proximate the centerpoint 29 of the cylinder 23.

The engine 21 includes an inlet piston crankshaft 35 arranged to rotate about an inlet piston crankshaft axis of rotation (IPA) and connected to the inlet piston by an inlet piston piston rod 37, and an exhaust piston crankshaft 39 arranged to rotate about an exhaust piston crankshaft axis of rotation (EPA) and connected to the exhaust piston by an exhaust piston piston rod 41.

The inlet piston crankshaft axis IPA and the exhaust piston crankshaft axis EPA both extend parallel to a central cylinder plane extending through the centerpoint 29 of the cylinder 23 and along a central axis A of the cylinder.

Figure 2:
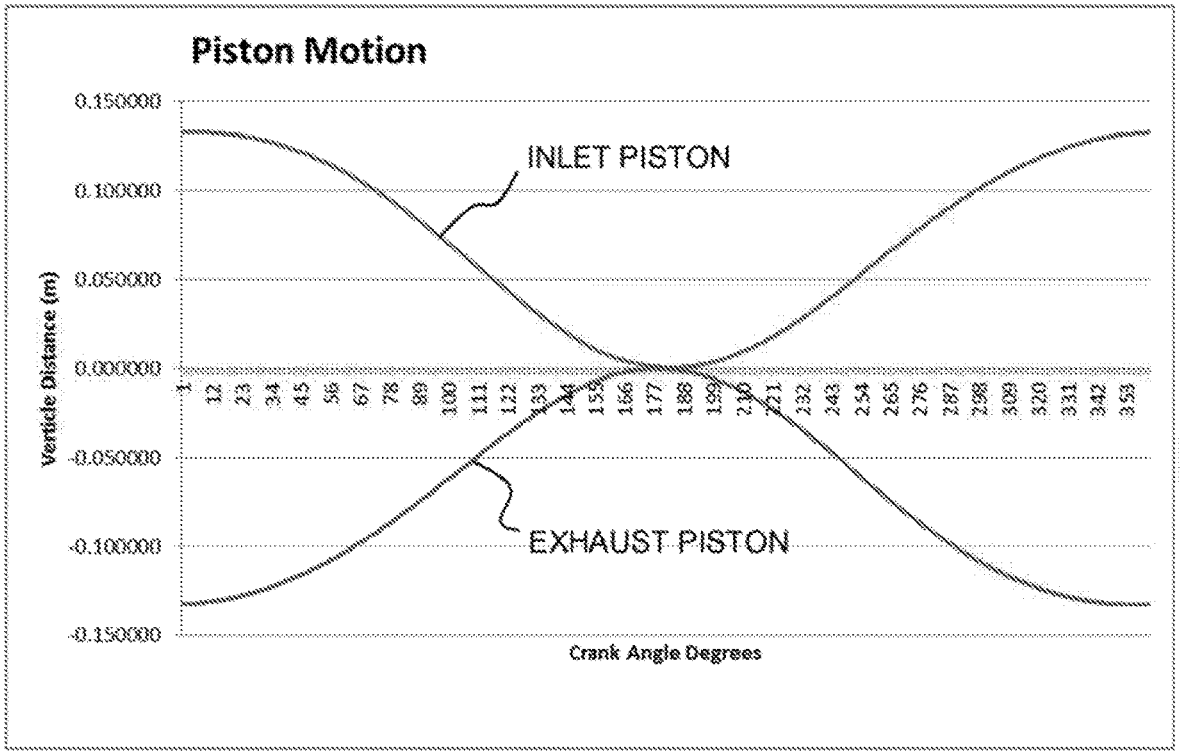
FIG. 2 is a graph of piston motion for an inlet piston and an exhaust piston of a modeled opposed piston engine, wherein the inlet piston and the exhaust piston are moved in phase, according to an aspect of the present invention.

The inlet piston crankshaft 35 and the exhaust piston crankshaft 37 are preferably arranged to rotate in phase. FIG. 2 is a graph illustrating vertical position of the inlet piston 31 at different crank angles of the inlet piston crankshaft 35 (upper curve) relative to vertical position of the exhaust piston 33 at different crank angles of the exhaust piston crankshaft 37 (lower curve), where the curves are mirror images of each other. By rotating the inlet piston crankshaft 35 and the exhaust piston crankshaft 37 in phase, kinematics of the system can be optimized to keep vibrations and stresses on the engine to a minimum.

Figure 3:
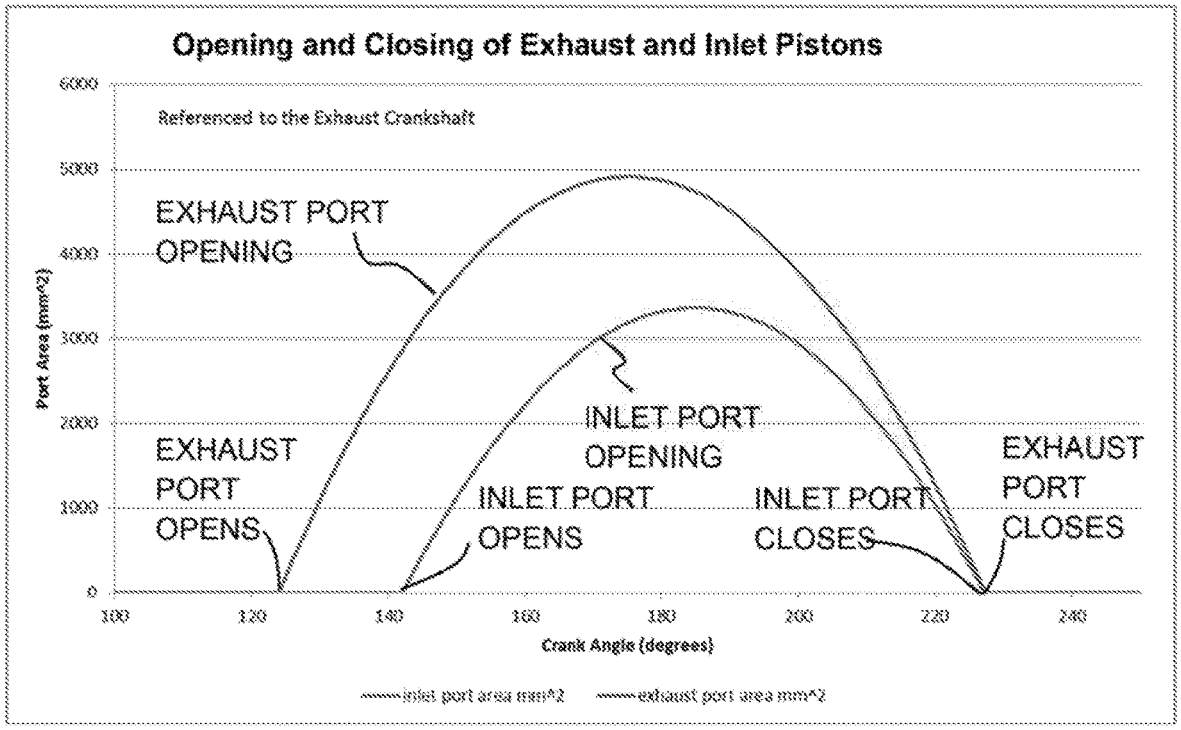
FIG. 3 is a graph illustrating inlet and outlet port opening and closing for a modeled opposed piston engine according to an aspect of the present invention.

The HIP and the HEP can be selected and the inlet piston crankshaft axis IPA and the exhaust piston crankshaft axis EPA can both be offset from the central cylinder plane by an inlet piston crankshaft axis offset ICO and an exhaust piston crankshaft axis offset ECO such that the inlet piston 31 moves through the IPCP as the inlet piston moves from IPBDC toward IPTDC to close the inlet port 25 at substantially a same time as the exhaust piston 33 moves through the EPCP as the exhaust piston moves from EPBDC toward EPTDC to close the exhaust port as illustrated graphically in FIG. 3. The inlet piston 31 is said to move through the IPCP at "substantially" a same time as the exhaust piston 33 moves through the EPCP in the sense that it may be desirable to have the exhaust piston close the exhaust port 27 slightly before the inlet piston closes the inlet port 25 to facilitate, e.g., removing any blowback gases from an intake channel (not shown) upstream of the inlet port. This can typically be accomplished by providing a lead of no more than about 2-3 crank angle degrees (CAD) for the exhaust piston crankshaft 39 relative to the inlet piston crankshaft 35.

Moving the inlet piston 31 through the IPCP at substantially the same time that the exhaust piston 33 moves through the EPCP facilitates improved engine kinematics by, inter alia, facilitating rotation of the inlet piston crankshaft 35 and the exhaust piston crankshaft 37 in phase while still providing for optimal timing of the opening and closing of the inlet port 25 and the exhaust port 27 without the need for the exhaust piston crankshaft to have a lead angle relative to the inlet piston crankshaft.

Further, by moving the inlet piston 31 through the IPCP at substantially the same time as the exhaust piston 33 moves through the EPCP, reverse torque losses that occur in conventional opposed piston engines where the intake piston lags the exhaust piston can be minimized or avoided because the entire or substantially the entire power stroke of the intake piston from IPTDC to IPBDC can occur after combustion has begun.

In addition to facilitating improved engine kinematics and reducing reverse torque losses by, inter alia, facilitating rotation of the inlet piston crankshaft 35 and the exhaust piston crankshaft 37 in phase, moving the inlet piston 31 through the IPCP at substantially the same time that the exhaust piston 33 moves through the EPCP in the manner described herein permits eliminating the use of an exhaust valve, which reduces weight, cost, and complexity of the engine.

Figure 4A:
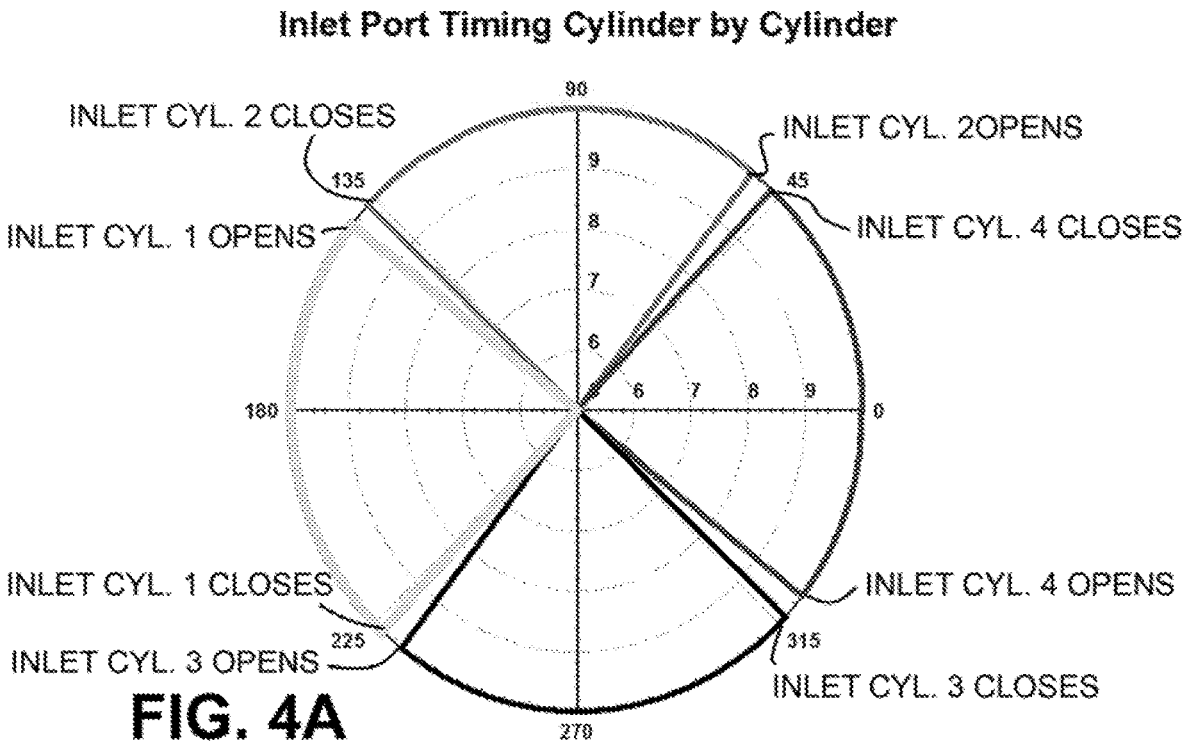
FIGS. 4A and 4B show opening and closing timings in terms of inlet and exhaust crankshaft angle degrees for a modeled four cylinder engine according to an aspect of the present invention.
Figure 4B:
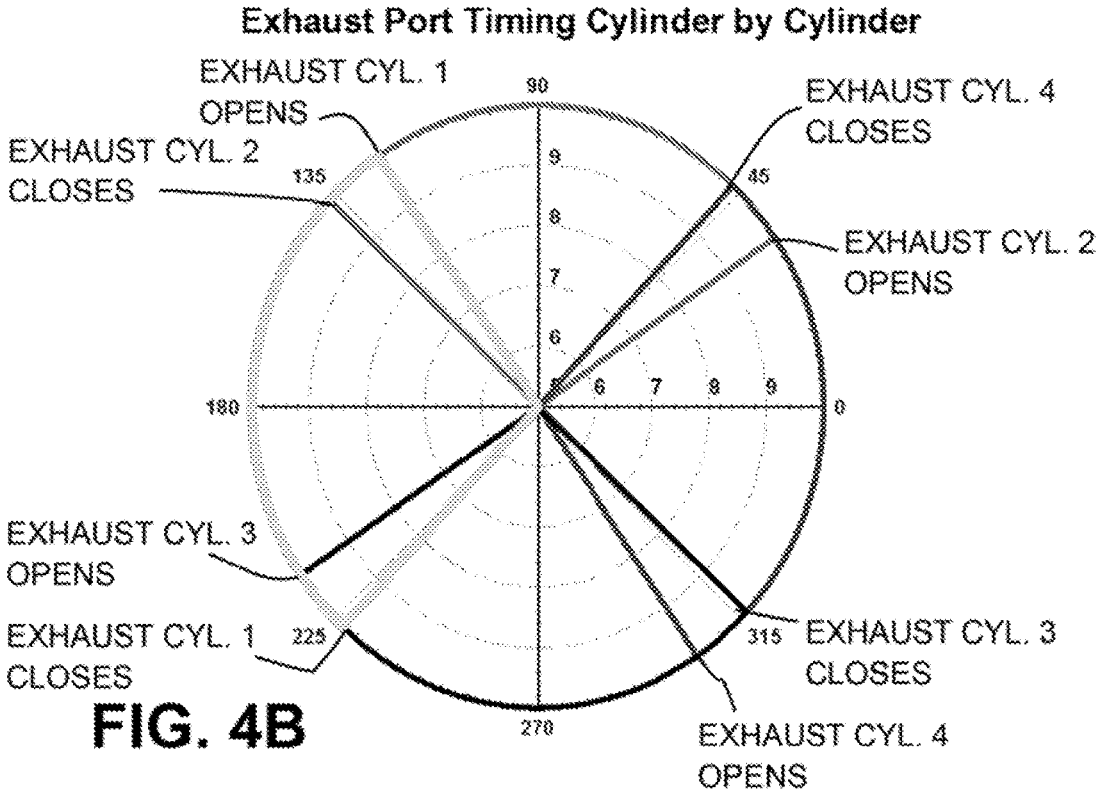

FIG. 3 also shows that the HIP and the HEP can be selected and the inlet piston crankshaft axis and the exhaust piston crankshaft axis can both be offset from the central cylinder plane by the ICO and the ECO such that the inlet piston 31 moves past the IPCP to open the inlet port 25 as the inlet piston moves from IPTDC toward IPBDC after the exhaust piston 33 moves past the EPCP to open the exhaust port 27 as the exhaust piston moves from EPTDC toward EPBDC. FIG. 4A shows opening and closing crank angles of inlet ports for an illustrative engine having four cylinders. It will be seen from FIG. 4A that the inlet port of cylinder 1 opens at a crank angle slightly greater than 135° and closes at a crank angle of 225°, the inlet port of cylinder 2 opens at a crank angle slightly greater than 225° and closes at a crank angle of 315°, the inlet port of cylinder 3 opens at a crank angle slightly greater than 315° and closes at a crank angle of 45°, and the inlet port of cylinder 4 opens at a crank angle slightly greater than 45° and closes at a crank angle of 135°. FIG. 4B shows opening and closing crank angles of exhaust ports for the illustrative engine of FIG. 4A having four cylinders. It will be seen from FIG. 4B that the exhaust port of cylinder 1 opens at a crank angle slightly less than 135° and closes at a crank angle of 225°, the exhaust port of cylinder 2 opens at a crank angle slightly less than 225° and closes at a crank angle of 315°, the exhaust port of cylinder 3 opens at a crank angle slightly less than 315° and closes at a crank angle of 45°, and the exhaust port of cylinder 4 opens at a crank angle slightly less than 45° and closes at a crank angle of 135°. Thus, the inlet ports of cylinders 1, 2, 3, and 4 all open a desired CAD after the exhaust ports of cylinders 1, 2, 3, and 4, respectively, while the inlet ports of cylinders 1, 2, 3, and 4 close at the same (or substantially the same) time as the exhaust ports of cylinders 1, 2, 3, and 4.

It is presently contemplated that the inlet piston 31 can move through the IPCP as the inlet piston moves from IPTDC toward IPBDC up to 30 CAD after the exhaust piston 33 moves through the EPCP as the exhaust piston moves from EPTDC toward EPBDC, although greater or lesser differences may be achieved. It is presently contemplated that the inlet piston 31 will move through the IPCP as the inlet piston moves from IPTDC toward IPBDC no more than about 20 CAD, and typically about 14-18 CAD, after the exhaust piston 33 moves through the EPCP as the exhaust piston moves from EPTDC toward EPBDC. Selection of an optimal difference in timing of the opening of the inlet port 25 and the exhaust port 27 is expected to vary from engine to engine depending upon a number of different engine characteristics.

It will be seen from FIG. 1 that the inlet piston crankshaft axis IPA and the exhaust piston crankshaft axis EPA are offset to a same side of the central cylinder plane. It is possible that the inlet piston crankshaft axis and the exhaust piston crankshaft axis could be offset to opposite sides of the central cylinder plane; however, it is expected that such an arrangement would suffer in terms of kinematics. Because of the enhanced kinematics of the engine with the inlet piston crankshaft axis IPA and the exhaust piston crankshaft axis EPA offset to a same side of the central cylinder plane as shown in FIG. 1, it is possible to have an extremely light weight engine with, for example, a light aluminum engine block disposed between two crankshaft bearing caps that are held together by through bolts while still permitting high cylinder pressures.

The inlet piston crankshaft axis IPA and the exhaust piston crankshaft axis EPA are ordinarily offset from the central cylinder plane by an equal distance. The optimal offset distance ICO and ECO will differ from engine to engine. While it is possible to offset the inlet piston crankshaft axis and the exhaust piston crankshaft axis from the central cylinder plane by different distances, offsetting them by the same distance is presently understood to provide optimal kinematics which, again, facilitates use of an extremely light weight engine with, for example, a light aluminum engine block disposed between two crankshaft bearing caps that are held together by through bolts while still permitting high cylinder pressures.

The HIP and the HEP are shown in FIG. 1 as being different heights but they can be the same height. If they are the same height, the inlet port 25 can still be closed at the same time as the exhaust port 27 by altering the structure of the engine 21, such as by making the distance of the top end of the inlet port 25 relative to the centerpoint 29 different from the distance of the top end of the exhaust port 27 relative to the centerpoint, offsetting the ICO a different amount than the ECO, and/or altering a length of the inlet piston piston rod 37 and the exhaust piston piston rod 41. Typically, however, the HEP is greater than the HIP, the top ends of the inlet port 25 and the exhaust port 27 are an equal distance from the centerpoint 29, and the inlet piston piston rod 37 and the exhaust piston piston rod 41 are a same length, all of which facilitates configuring the engine 21 so that the ICO and the ECO are the same and stresses on the engine can be kept to a minimum to optimize kinematics.

Figure 5:
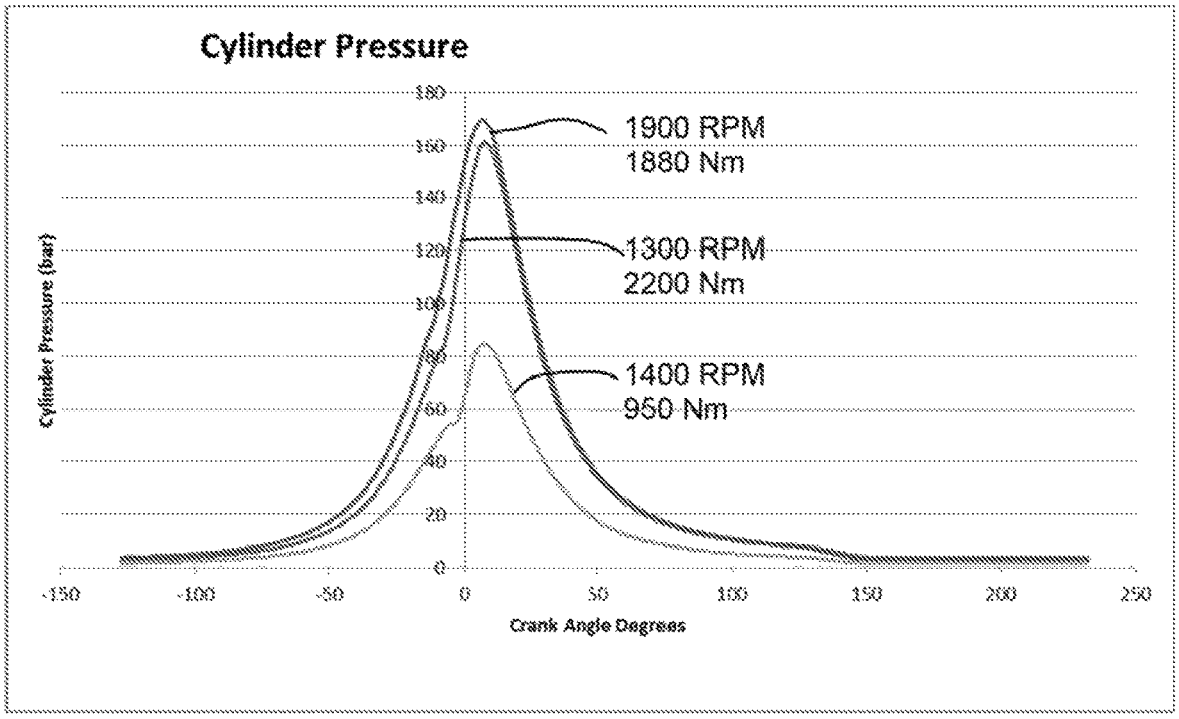
FIG. 5 shows cylinder pressure for maximum torque, rated speed, and cruising operation modes in a modeled opposed piston engine according to an aspect of the present invention.
Figure 6:
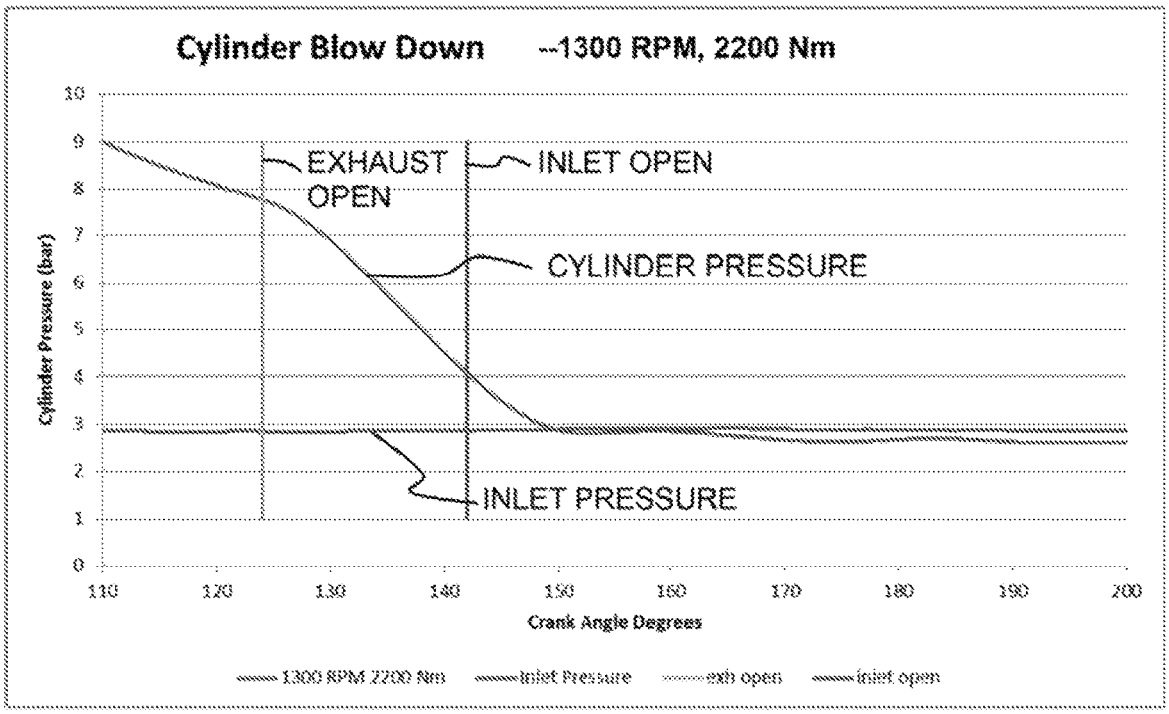
FIG. 6 shows cylinder blow down pressure in a cylinder of a modeled opposed piston engine according to an aspect of the present invention wherein the engine is operated at maximum torque.
Figure 7:
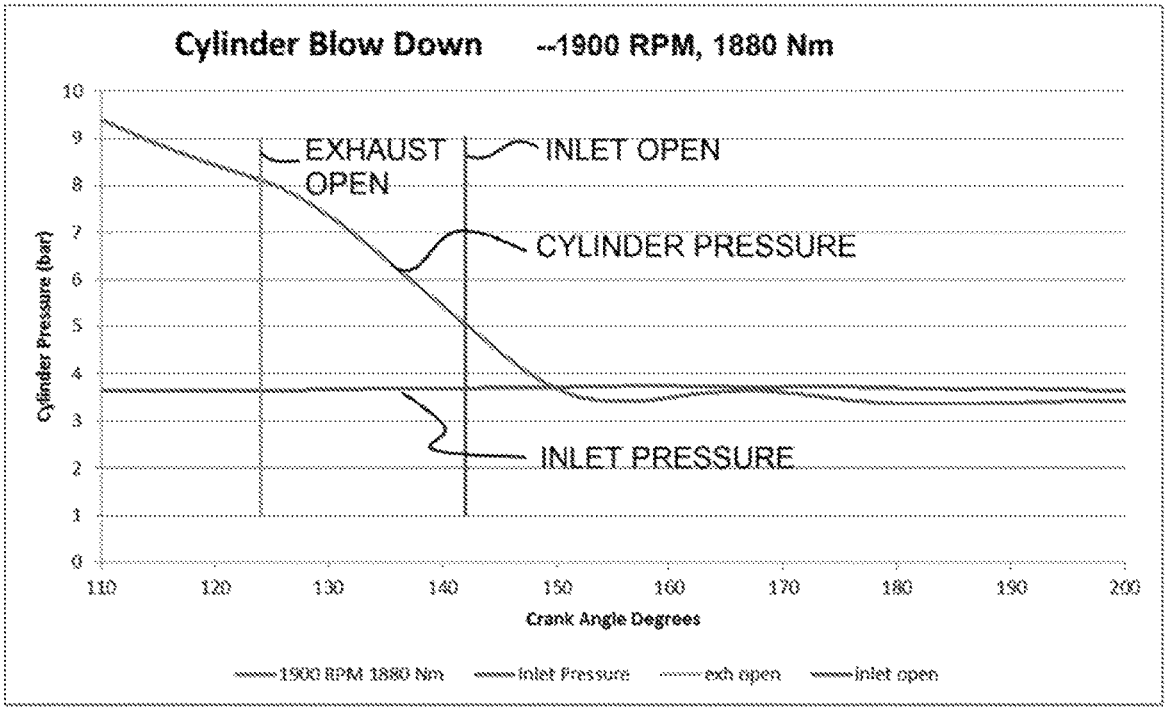
FIG. 7 shows cylinder blow down pressure in a cylinder of a modeled opposed piston engine according to an aspect of the present invention wherein the engine is operated at rated speed.

FIG. 5 shows cylinder pressures for an illustrative modeled opposed piston engine with offset inlet piston and exhaust piston crankshafts and no crankshaft phase shift at maximum torque operation (1300 RPM, 2200 Nm), at rated speed operation (1900 RPM, 1880 Nm), and at cruise operation (1400 RPM, 950 Nm), where the combustion event was slightly before TDC for the maximum torque and rated speed operation, and at TDC for cruise operation. FIGS. 6 and 7 show the cylinder blow down process for the maximum torque operation and rated speed operation shown in FIG. 5 and show that, by opening the exhaust port sufficiently before the inlet port, blow down can be nearly complete before the inlet port opens, which can prevent or reduce blow back into an inlet plenum and manifold upstream of the inlet port.

Figure 8:
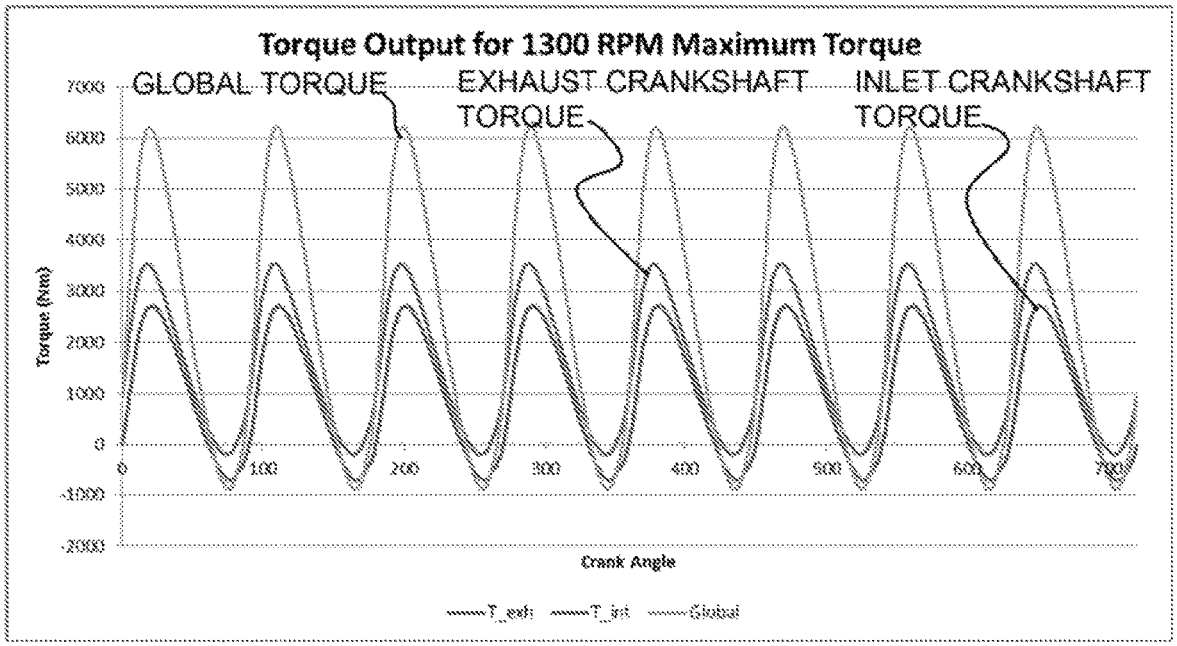
FIG. 8 shows torque output for a modeled opposed piston engine according to an aspect of the present invention wherein the engine is operated at maximum torque.
Figure 9:
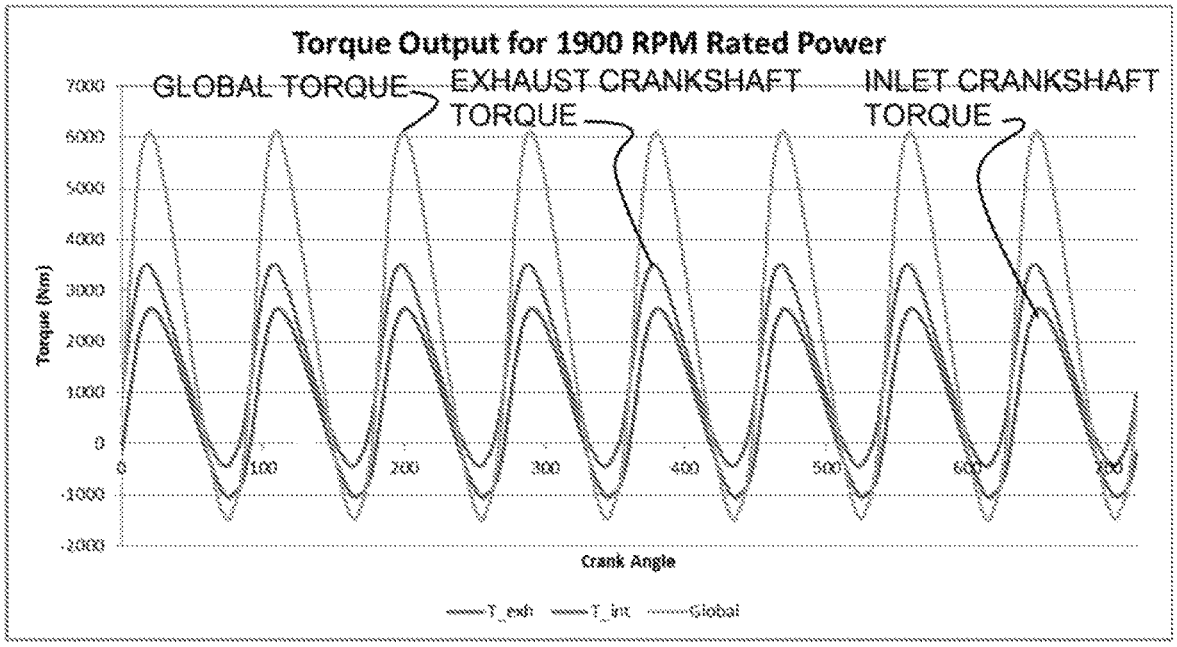
FIG. 9 shows torque output for a modeled opposed piston engine according to an aspect of the present invention wherein the engine is operated at rated speed.

In conventional opposed piston engines where there is a crankshaft phase angle shift, a certain portion of the movement of the inlet piston toward TDC occurs after the combustion event, leading to significant torque reversal. In any opposed piston engine, torque necessary to turn the engine against friction is typically split unevenly between the exhaust crankshaft and the intake crankshaft. During operation, torque transmitted by the exhaust crankshaft and the intake crankshaft is also typically split unevenly. FIGS. 8 and 9 show dynamic torque at the inlet crankshaft and the exhaust crankshaft and total (global, or inlet crankshaft torque plus exhaust crankshaft torque) for a modeled four cylinder, opposed piston engine with offset inlet piston and exhaust piston crankshafts and no crankshaft phase shift at maximum torque operation (1300 RPM, 2200 Nm), at rated speed operation (1900 RPM, 1880 Nm). The high levels of torque reversals (portion of the curves below the 0 Nm line) that are typically developed in conventional engines with a crankshaft phase angle shift were not present. In the modeled engine, the intake crankshaft had higher levels of negative dynamic torque compared to the exhaust crankshaft as shown in FIG. 8 and FIG. 9. In the modeled engine, the average torque split was about 38% inlet to about 62% exhaust crankshaft for maximum torque operation and about 35% inlet to about 65% exhaust crankshaft for rated power operation.

Positive and reverse torque values for a modeled engine having no crankshaft offset but with a 10 degree phase angle shift between the input and exhaust crankshafts were obtained for maximum torque (1300 RPM) and rated speed (1900 RPM) operation for comparison with the positive and reverse torque values for the modeled engine having crankshaft offset shown in FIGS. 8 and 9 for maximum torque (1300 RPM) (FIG. 8) and rated speed operation (1900 RPM) (FIG. 9). The modeled engines were identical except that one has no crankshaft offset and one has crankshaft offset. The positive and reverse torque values for the modeled engine having no crankshaft offset and with a 10 degree phase angle shift is shown in Table 1 below:

Crankshaft With No Crankshaft Offset and with 10° Phase Angle Shift

| | 1300 RPM | | 1900 RPM | |
|---|---|---|---|---|
| | Reverse Torque | Positive Torque | Reverse Torque | Positive Torque |
| Inlet Crankshaft | 1750 | 3800 | 1600 | 2500 |
| Exhaust Crankshaft | 700 | 7200 | 200 | 6500 |
| Global | 2450 | 11000 | 1800 | 9000 |

The positive and reverse torque values for the modeled engine having a crankshaft offset and no phase angle shaft is shown in Table 2 below:

Crankshaft With Crankshaft Offset and No Phase Angle Shift

| | 1300 RPM | | 1900 RPM | |
|---|---|---|---|---|
| | Reverse Torque | Positive Torque | Reverse Torque | Positive Torque |
| Inlet Crankshaft | 800 | 2750 | 1050 | 2600 |
| Exhaust Crankshaft | 200 | 3500 | 400 | 3500 |
| Global | 1000 | 6250 | 1450 | 6100 |

The percent difference between the values shown in Table 1 and Table 2 is shown in Table 3 below:

Percent Differences Between No Crankshaft Offset With Phase Shift and Crankshaft Offset and No Phase Shift

| | 1300 RPM | | 1900 RPM | |
|---|---|---|---|---|
| | Reverse Torque | Positive Torque | Reverse Torque | Positive Torque |
| Inlet Crankshaft | 119% | 38% | 52% | −4% |
| Exhaust Crankshaft | 250% | 106% | −50% | 86% |
| Global | 145% | 76% | 24% | 48% |

The information shown in Tables 1, 2, and 3 demonstrates that reduced reverse torque can be obtained in a modeled engine having a crankshaft offset and no phase angle shaft relative to a modeled engine having no crankshaft offset and with a phase angle shift. While positive torque values may also be reduced, it is presently understood that a desirable balance between reverse torque and positive torque can be obtained to achieve results that are optimized. Additionally, reduction of reverse torque can substantially reduce wear on the engine and can permit use of less massive engine components.

In a method of operating an opposed piston engine 21 according to an aspect of the present invention, where the engine includes a cylinder 23 having an inlet port 25 and an exhaust port 27 disposed on opposite sides of a centerpoint 29 of the cylinder, an inlet piston 31 is reciprocated in the cylinder between an IPBDC and an IPTDC, thereby rotating an inlet piston crankshaft 35 connected to the inlet piston by an inlet piston piston rod 37 about an IPA. At the same time as the inlet piston 31 is reciprocated in the cylinder 23, an exhaust piston 33 is reciprocated in the cylinder between an EPBDC and an EPTDC, thereby rotating an exhaust piston crankshaft 39 connected to the exhaust piston by an exhaust piston piston rod 41 about an EPA. According to the method, both the IPA and the EPA are offset from a central cylinder plane extending through the centerpoint 29 of the cylinder 23 and along a central axis A of the cylinder, the IPA and the EPA both extending parallel to the central cylinder plane, so that the inlet piston 31 closes the inlet port as the inlet piston moves from IPBDC toward IPTDC at substantially a same time as the exhaust piston 33 closes the exhaust port as the exhaust piston moves from EPBDC toward EPTDC. The inlet piston crankshaft 35 and the exhaust piston crankshaft 39 are preferably rotated in phase.

By offsetting the inlet piston crankshaft and the exhaust piston crankshaft in the manner described herein, timing of the opening and closing of the inlet and exhaust ports can be altered in a variety of ways, and can avoid the need for an exhaust port valve, thereby simplifying the construction of the engine. Altering the timing of the opening and closing of the inlet and exhaust ports by offsetting the crankshafts facilitates operating the engine with no crankshaft phase shift, which facilitates providing improved engine kinematics and the use of a lighter weight engine. Provision of optimally timed inlet and exhaust port opening and closing by the crankshaft offset, and elimination of the phase shift, further facilitates reduction of torsional losses due to the combustion event occurring while the inlet piston is still moving toward TDC as typically occurs in conventional engines that utilize a phase shift.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. An opposed piston engine, comprising:

a cylinder having an inlet port and an exhaust port disposed on opposite skies of a centerpoint of the cylinder;

an inlet piston arranged to reciprocate in the cylinder between an inlet piston bottom dead center position (IPBDC) and an inlet piston top dead center position (IPTDC), the inlet piston closing the inlet port when the inlet piston moves through inlet port closed position (IPCP) as the inlet piston moves through at least a distance of an axial height (HIP) of the inlet port from IPBDC toward IPTDC and the inlet piston opening the inlet port when the inlet piston moves through the IPCP as the inlet piston moves from IPTDC to IPBDC;

an exhaust piston arranged to reciprocate in the cylinder between an exhaust piston bottom dead center position (EPBDC) and an exhaust piston top dead center position (EPTDC), the exhaust piston closing the exhaust port when the exhaust piston moves through an exhaust port closed position (EPCP) the exhaust piston moves through at least a distance of an axial height (HEP) of the exhaust port from EPBDC toward EPTDC and the exhaust piston opening the exhaust port when the exhaust piston moves through the EPCP as the exhaust piston moves from EPTDC to EPBDC;

an inlet piston crankshaft arranged to rotate about an inlet piston crankshaft axis of rotation and connected to the inlet piston by an inlet piston rod; and an exhaust piston crankshaft arranged to rotate about an exhaust piston crankshaft axis of rotation and connected to the exhaust piston by an exhaust piston rod, wherein the inlet piston crankshaft axis and the exhaust piston crankshaft axis both extend parallel to a central cylinder plane extending through the centerpoint of the cylinder and along a central axis of the cylinder, wherein the inlet piston crankshaft and the exhaust piston crankshaft are arranged to rotate in phase, and wherein the HIP and the HEP are selected and the inlet piston crankshaft axis and the exhaust piston crankshaft axis are both offset from the central cylinder plane such that the inlet piston moves through the IPCP as the inlet piston moves from IPBDC toward IPTDC at substantially a same time as the exhaust piston moves through the EPCP as the exhaust piston moves from EPBDC toward EPTDC.

2. The opposed piston engine as set forth in claim 1, wherein the HIP and the HEP are selected and the inlet piston crankshaft axis and the exhaust piston crankshaft axis are both offset from the central cylinder plane such that the inlet piston moves through the IPCP as the inlet piston moves from IPTDC toward IPBDC after the exhaust piston moves through the EPCP as the exhaust piston moves from EPTDC toward EPBDC.

3. The opposed piston engine as set forth in claim 2, wherein the inlet piston moves through the IPCP as the inlet piston moves from IPTDC toward IPBDC up to 30 Crank Angle Degrees after the exhaust piston moves through the EPCP as the exhaust piston moves from EPTDC toward EPBDC.

4. The opposed piston engine as set forth in claim 1, wherein the inlet piston crankshaft axis and the exhaust piston crankshaft axis are offset to a same side of the central cylinder plane.

5. The opposed piston engine as set forth in claim 4, wherein the inlet piston crankshaft axis and the exhaust piston crankshaft axis are offset from the central cylinder plane by an equal distance.

6. The opposed piston engine as set forth in claim 1, wherein the inlet piston crankshaft axis and the exhaust piston crankshaft axis are offset, from the central cylinder plane by an equal distance.

7. The opposed piston engine as set forth in claim 1, wherein an axial height of the inlet port is different from an axial height of the exhaust port.

8. The opposed piston engine as set forth in claim 7, wherein the axial height of the exhaust port is greater than the axial height of the inlet port.

9. The opposed piston engine as set forth in claim 1, wherein the inlet piston rod and the exhaust piston rod are a same length.

10. An opposed piston engine, comprising:

a cylinder having an inlet port and an exhaust port disposed on opposite sides of a centerpoint of the cylinder;

an inlet piston arranged to reciprocate in the cylinder between an inlet piston bottom dead center position (IPBDC) and an inlet piston top dead center position (IPTDC);

an exhaust piston arranged to reciprocate in the cylinder between an exhaust piston bottom dead center position (EPBDC) and an exhaust piston top dead center position (EPTDC);

an inlet piston crankshaft arranged to rotate about an inlet piston crankshaft axis of rotation and connected to the inlet piston bye an inlet piston rod; and an exhaust piston crankshaft arranged to rotate about an exhaust piston crankshaft axis of rotation and connected to the exhaust piston by an exhaust piston rod, wherein the inlet piston crankshaft axis and the exhaust piston crankshaft axis both extend parallel to a central cylinder plane extending through the centerpoint of the cylinder and along a central axis of the cylinder, wherein the inlet piston crankshaft axis and the exhaust piston crankshaft axis are both offset from the central cylinder plane, and wherein the inlet piston and the exhaust piston are arranged so that the inlet piston closes the inlet port as the inlet piston moves from IPBDC toward IPTDC at substantially a same time as the exhaust piston closes the exhaust port as the exhaust piston moves from EPBDC toward EPTDC.

11. The opposed piston engine as set forth in claim 10, wherein the inlet piston crankshaft and the exhaust piston crankshaft are arranged to rotate in phase.

12. The opposed piston engine as set forth in claim 10, wherein the inlet piston and the exhaust piston are arranged so that the inlet piston opens the inlet port as the inlet piston moves from IPTDC toward IPBDC after the exhaust piston opens the exhaust port as the exhaust piston moves from EPTDC toward EPBDC.

13. The opposed piston engine as set forth in claim 12, wherein the inlet piston is arranged to open the inlet port as the inlet piston moves from IPTDC toward IPBDC up to 30 Crank Angle Degrees after the exhaust piston opens the exhaust port as the exhaust piston moves from EPTDC toward EPBDC.

14. The opposed piston engine as set forth in claim 10, wherein the inlet piston crankshaft axis and the exhaust piston crankshaft axis are offset to a same side of the central cylinder plane.

15. The opposed piston engine as set forth in claim 14, wherein the inlet piston crankshaft axis and the exhaust piston crankshaft axis are offset from the central cylinder plane by an equal distance.

16. The opposed piston engine as set forth in claim 10, wherein the inlet piston crankshaft axis and the exhaust piston crankshaft axis are offset from the central cylinder plane by an equal distance.

17. The opposed piston engine as set forth in claim 10, wherein an axial height of the inlet port is different from an axial height of the exhaust port.

18. The opposed piston engine as set forth in claim 17, wherein the axial height of the exhaust port is greater than the axial height of the inlet port.

19. A method of operating an opposed piston engine, the opposed piston engine including a cylinder having an inlet port and an exhaust port disposed on opposite sides of a centerpoint of the cylinder, comprising:

reciprocating an inlet piston in the cylinder between an inlet piston bottom dead center position (IPBDC) and an inlet piston top dead center position (IPTDC) and thereby rotating an inlet piston crankshaft connected to the inlet piston by an inlet piston rod about an inlet piston crankshaft axis of rotation;

reciprocating an exhaust piston in the cylinder between an exhaust piston bottom dead center position (EPBDC) and an exhaust piston top dead center position (EPTDC) and thereby rotating an exhaust piston crankshaft connected to the exhaust piston by an exhaust piston rod about an exhaust piston crankshaft axis of rotation; and offsetting both the inlet piston crankshaft axis and the exhaust piston crankshaft axis from a central cylinder plane extending through the centerpoint of the cylinder and along a central axis of the cylinder, the inlet piston crankshaft axis and the exhaust piston crankshaft axis both extending parallel to the central cylinder plane, so that the inlet piston closes the inlet port as the et piston moves from IPBDC toward IPTDC at substantially a same time as the exhaust piston closes the exhaust port as the exhaust piston moves from EPBDC toward EPTDC.

20. The method as set forth in claim 19, comprising rotating the inlet piston crankshaft and the exhaust piston crankshaft in phase.

* * * * *